United States Patent [19]

Sterns

[11] Patent Number: 4,764,771

[45] Date of Patent: Aug. 16, 1988

[54] ANTENNA FEED NETWORK EMPLOYING OVER-COUPLED BRANCH LINE COUPLERS

[75] Inventor: William G. Sterns, Canoga Park, Calif.

[73] Assignee: ITT Gilfillan, a division of ITT Corporation, Van Nuys, Calif.

[21] Appl. No.: 892,235

[22] Filed: Aug. 4, 1986

[51] Int. Cl.[4] ..... H01Q 3/22; H01Q 3/24; H01Q 3/26

[52] U.S. Cl. ..... 342/373; 333/116; 342/375

[58] Field of Search ..... 333/115, 116, 117, 123; 342/373, 375

[56] References Cited

U.S. PATENT DOCUMENTS 3,345,585 10/1967 Hildebrand ..... 333/116

3,400,405 9/1968 Patterson, Jr. ..... 342/375 X 4,415,867 11/1983 Rubin ..... 333/116 X

*Primary Examiner*—Paul Gensler

*Attorney, Agent, or Firm*—Robert A. Walsh; Thomas N. Twomey; Mary C. Werner

[57] ABSTRACT

An antenna feed network implemented preferably in stripline for connecting the elements of a linear or planar array with a common port for transmit/receive operation. The network acts as a power divider/combiner and is entirely reciprocal. The network is realized in the form of a pattern of conductive traces on a single dielectric sheet of the stripline arrangement between parallel, spaced ground planes and does not require interconnections among multiple planes. The network may be utilized as a single or multiple beam forming network with the path lengths to the respective array radiators patterned to achieve a frequency scanning or beam normal array design.

6 Claims, 5 Drawing Sheets

ANTENNA FEED NETWORK EMPLOYING OVER-COUPLED BRANCH LINE COUPLERS

BACKGROUND OF THE INVENTION

1. Field of the Invention

The invention relates generally to antenna feed systems, particularly in the microwave frequency bands.

2. Description of the Prior Art

A wealth of antenna coupling technology is extant in the prior art. The text "An Antenna Engineering Handbook." Henry Jasik. Editor, McGraw-Hill 1961 (first edition) describes much of this prior art. In addition, the text "Radar Handbook", Merrill Skolnick, Editor (McGraw Hill 1970) presents an overview of the state of this art at the time of its publication. That reference also serves to acquaint the reader with microwave system aspects requiring and utilizing circuits of the class to which the invention belongs.

In the prior art, stripline implementations of antenna multi-element feeds have frequently required rather complex trace cross-overs or connections between more than one plane of conductive traces. Single plane cross-overs inherently produce undesired coupling and the cost of manufacture of multi-plane devices is relatively high. The manner in which the invention contributes to this art to provide a simpler, more easily manufactured stripline feed network will be evident as this description proceeds.

Microwave stripline type components for related purposes are described in the patent literature, for example U.S. Pat. No. 4,460,877 entitled "Broad-band Printed Circuit Balun Employing Coupled-Strip All Pass Filters" and copending U.S. Pat. No. 4,578,652 issued Mar. 25, 1986 entitled Broadband Four-Port TEM Mode 180° Printed Circuit Microwave Hybrid. Those disclosures show stripline implemented circuits in which the circuit traces are printed circuits held between parallel ground planes, as is the case for the invention. U.S. Pat. No. 3,518,688, discloses a low loss, high strength honeycomb arrangement for effecting the overall structure mechanically. That technique is applicable to the devices of the aforementioned patents and also to this invention.

The basis for the type of circuit coupling to form more than one beam, as employed in the invention, is examined in a paper included in the Transaction of IEEE, Vol. Ap-16, July 1968 pp. 436–440. The resulting feed concept has been referred to as a Lopez Feed.

SUMMARY OF THE PRESENT INVENTION

In consideration of the disadvantages of the pertinent prior art, it may be said to have been the general object of the invention to provide a stripline antenna feed in which the conductive traces are in a single plane (without cross-overs in the plane) forming over-coupled branch-line couplers. The device is therefore relatively easily and inexpensively manufactured.

The single-plane printed circuit traces sandwiched between spaced ground planes according to the invention are folded in a plurality of trombone-like sections successively coupled by means of a plurality of discretely spaced, quarter-wave conductive cross-over traces forming individual directional couplers. One output of each coupled trace of each of the sections feeds a corresponding array element and another passes most of the power on to successive sections.

The circuit of the invention may be thought of as a plurality of four port directional couplers in stripline form, each directional coupler having an input port and a diagonal port into which most of the input RF power is diverted. Couplings between 10 db and 25 db can be easily provided, while a fourth port is terminated.

The details of a typical stripline implementation of the invention are presented hereinafter.

DETAILED DESCRIPTION OF THE PREFERRED EMBODIMENT

Although it is to be understood that the circuit of the invention is entirely reciprocal, it will be described in terms of the transmitting mode.

Although the invention would be broadly applicable to any RF frequency, it is most practical in the microwave region where physical sizes are small. Also, the invention may be thought of as realizable in any TEM mode transmission line medium, it is most practical in stripline form.

Figure 1:
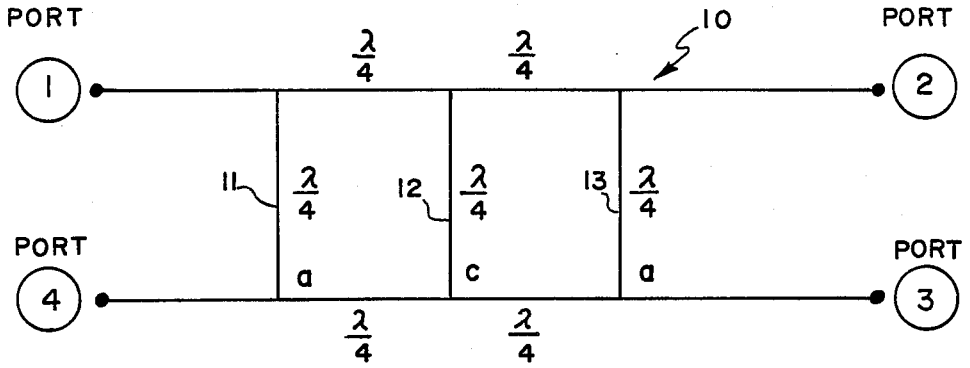
FIG. 1 is a basic illustration of the unique directional coupler according to the invention.
Figure 2:
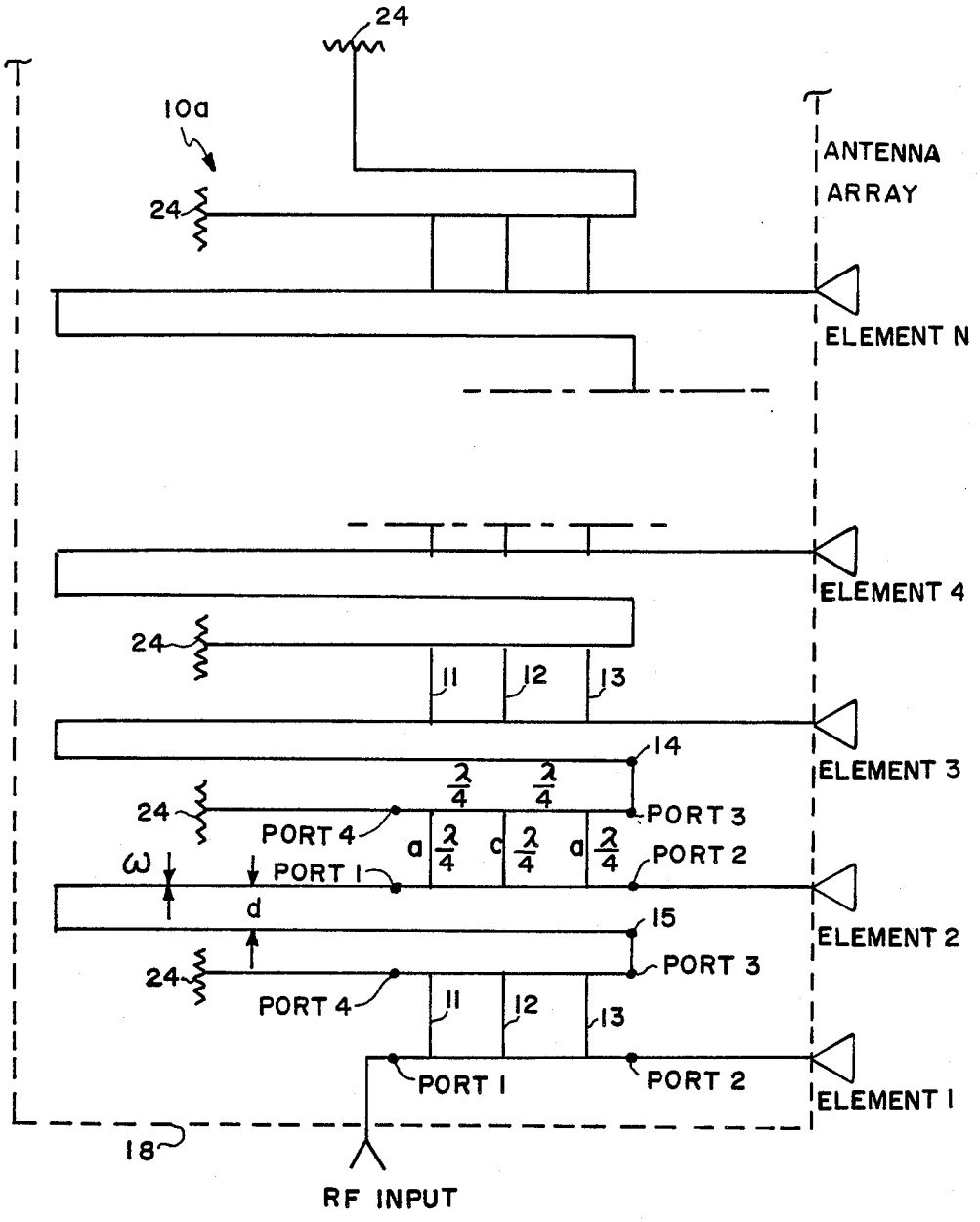
FIG. 2 is a schematic of the single plane traces on the center plane of a stripline device; according to the invention, for feeding "N" antenna elements of an array from an RF input port in a frequency scanning system.

Referring now to FIG. 1 showing a cross-over coupling section generally at 10, it will be assumed that port 1 is excited from a source of RF power (not shown) via a common input port. It is desired that most of the input power be coupled to port 3, since this power proceeds down the line to the further sections. An arbitrary portion of the input power is diverted (coupled) to port 2 of each section and from there is diverted to a corresponding antenna element (1 through N) as shown in FIG. 2. port 4 terminated in a characteristic impedance 24 of the lines is also shown in FIG. 2. Thus, the assembly of FIG. 1 comprised of cross-over directional coupler sections 10 arranged as shown in FIG. 2 operates as a transverse electro-magnetic (TEM) power distributor/-combiner.

Most of the power at port 1 in FIG. 1 exits at port 3 and an arbitrary lesser amount of power is coupled to port 2. In a similarly labeled conventional branch-line hybrid most of the power would be coupled to port 2 from port 1 and a minimum of (−10 db) would appear at port 3.

Three one-quarter wave conductive cross-over traces 11, 12 and 13 are shown in FIG. 1, although the invention is not limited to that number of conductive cross-over traces. In fact, the use of four or more cross-over traces in each directional coupler section broadens the bandwidth of the circuit with little increase in complexity.

Figure 3:
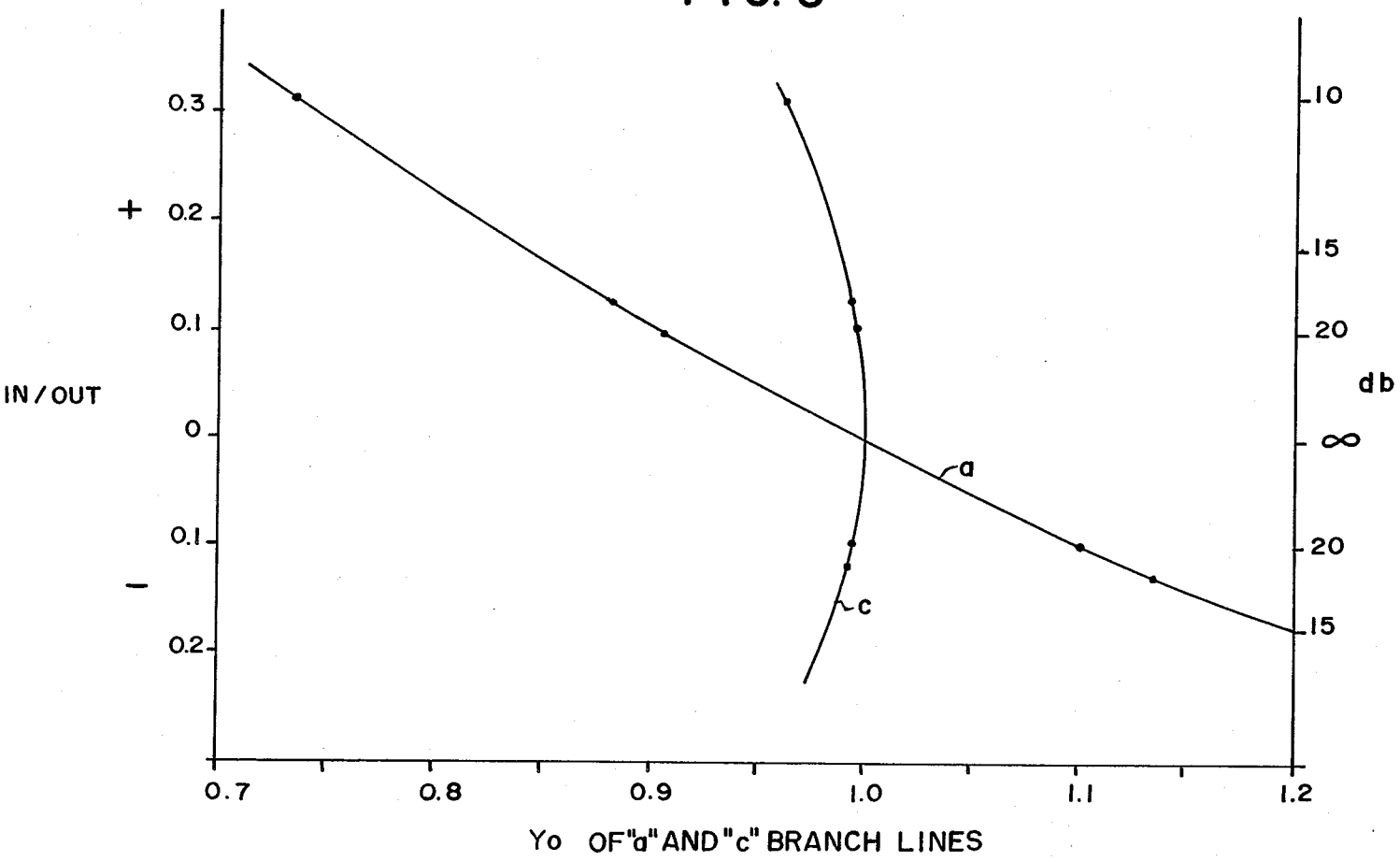
FIG. 3 is a plot relating coupling to a corresponding antenna element as it relates to cross-over admittances.

In FIG. 2 identified by the general reference character 10*a*, the three cross-over traces are identified as "a" (the two outside traces) and "c" (the center trace). If the input admittance at port 1 is arbitrarily identified as Y=1, and the admittances of the through lines are Yo=1, then relative or normalized admittances for the three conductive cross-over traces 11, 12 and 13 can be determined and the plot on FIG. 3 relates those admittances to the coupling from port 1 to port 2, i.e., the portion of the input power diverted to an antenna (radiator) element (1 through N). Table I following presents the data of FIG. 3 for particular couplings of the device ideal for use as an antenna feed for a frequency scanning radar system. Note that FIG. 2 is the frequency scanning configuration. The phase delay between adjacent elements is determined as a function of the electrical length from a point 15 and a point 14 and the corresponding points for other sections. The length of the conductive trace leading from port 4 of the directional coupler to the termination characteristic impedance 24 is arbitrary. The parallel spacing d of the conductive traces connecting port 3 of one directional coupler to port 1 of the following coupler should be at least "3w" for adequate decoupling (where "w" is the trace width).

Figure 2A:
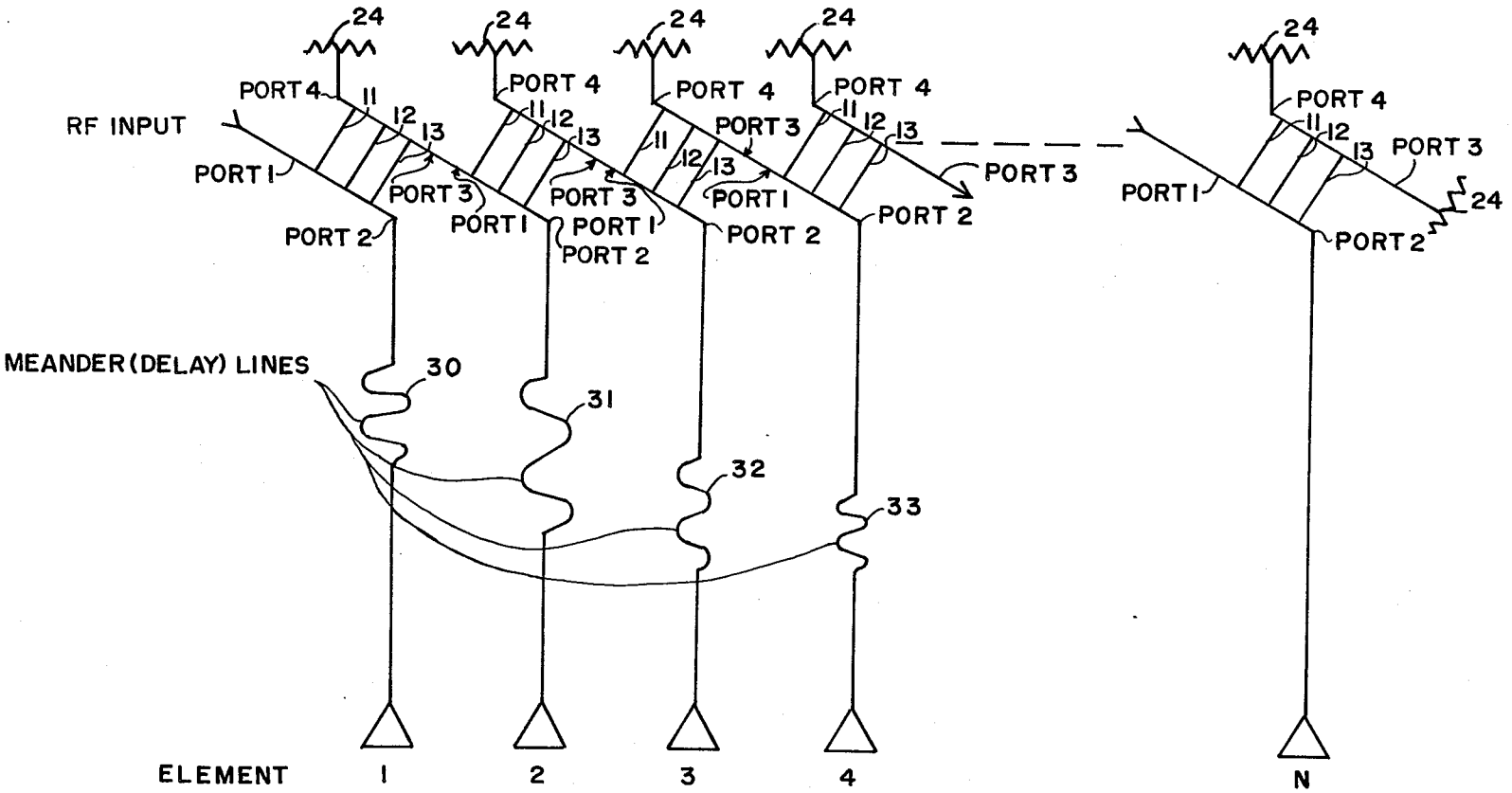
FIG. 2A is a schematic of the single plane traces configured for a beam normal system.

However, FIG. 2A is the beam normal configuration wherein a plurality of meander line lengths 30, 31, 32, 33 produce a constant electrical phase at the antenna (radiator) elements (1–N) independent of frequency. FIG. 2A represents the beam normal configuration because the electrical path lengths from the RF input to each antenna (radiator) element (1–N) is constant. Note that FIG. 2A has a single RF input with each directional coupler terminating in the characteristic impedance 24. Each of the parallel sections of transmission lines are separated by the three one-quarter wave conductive cross-over traces 11, 12 and 13 with the output port (port 2) leading to the corresponding antenna (radiator) element (1–N) via one of the meander lines 30–33 employed for electrical phase matching.

TABLE I

| Coupling (db) from Port 1 to Port 2 | Cross-over trace "a" Normalized Admittance | Cross-over trace "c" Normalized Admittance |
|---|---|---|
| −18 | 0.8811 | 0.9920 |
| −18.5 | 0.8874 | 0.9929 |
| −19.0 | 0.8934 | 0.9937 |
| −20 | 0.9045 | 0.9950 |

The characteristic admittance of the circuit $Y_o$ is determined by well-known parameters including the trace width and the ground plane spacing as $$Yo = f(w, b, \epsilon)$$

where

YO=characteristic admittance, f is a determinable function, w is the trace width, b is the ground plane spacing, and $\epsilon$ is the dielectric constant of materials between the ground planes.

It therefore follows that the directional coupler branches "a" and "c" admittances can be established by predetermination of their trace widths accordingly for a give "b" and "$\epsilon$."

It can be shown that the admittances of branches "a" and "c" do not affect the phase relationships between ports 2 and 3 of the directional coupler 10. It can also be shown that the port 2 signal amplitude (power) decreases as the excitation frequency varies from center frequency.

Another set of solutions is possible for the directional coupler parameters achieving the same power distribution but providing increasing signal amplitude at port 2 as the frequency varies from design center. The "a" and "c" branch normalized admittances for mid-range coupling values are according to Table II for this variation.

TABLE II

| Coupling (db) from Port 1 to Port 2 | Cross-over trace "a" Normalized Admittance | Cross-over trace "c" Normalized Admittance |
|---|---|---|
| −18.0 | 1.1353 | 0.9920 |
| −18.5 | 1.1270 | 0.9929 |
| −19.0 | 1.1191 | 0.9937 |
| −19.5 | 1.1119 | 0.9944 |
| −20.0 | 1.1054 | 0.9950 |

In the variation according to Table II, the phase of the port 2 signal lags that of the port 3 signal whereas in the Table I solution the phase of the port 3 signal lags that of the port 2 signal. This will be evident from FIG. 3.

Figure 2B:
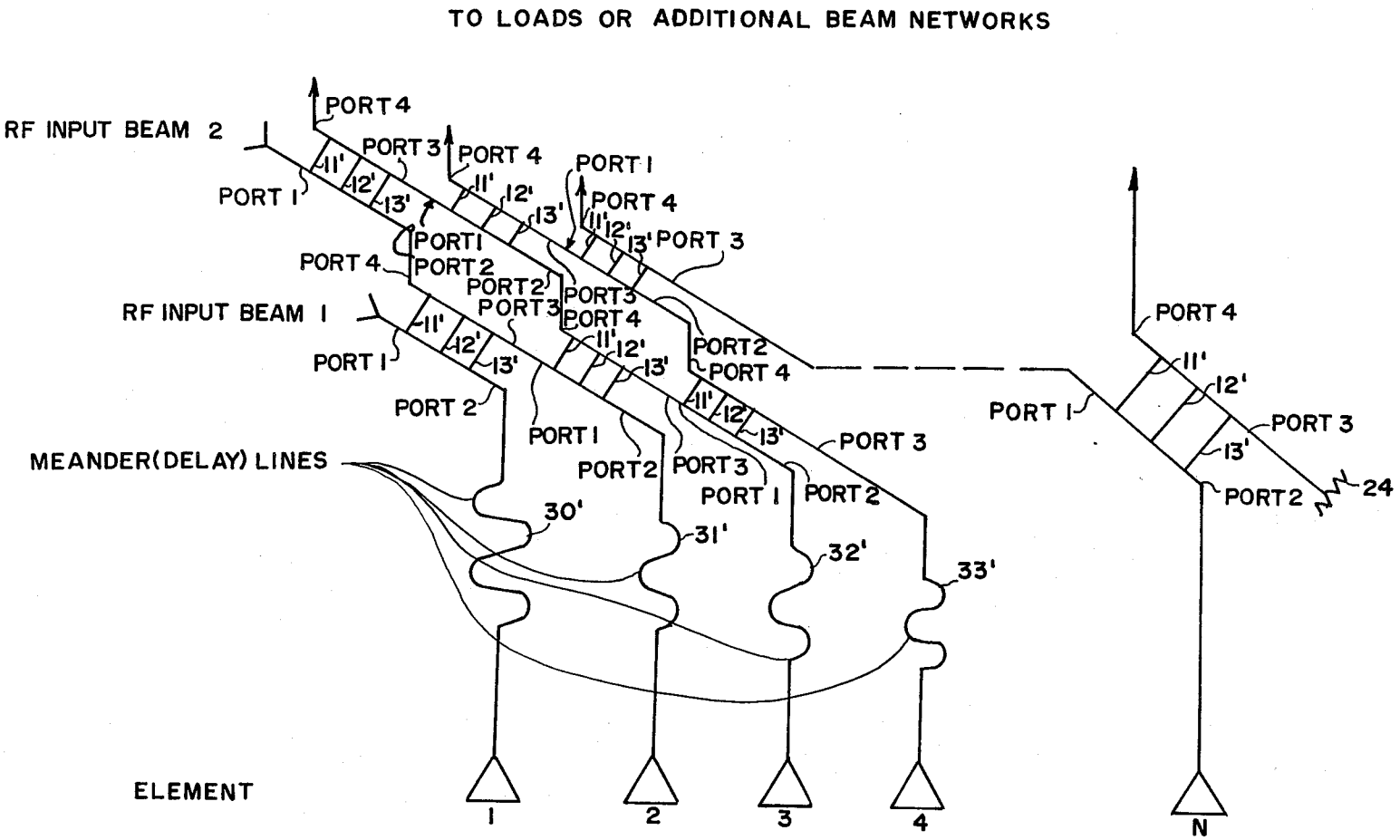
FIG. 2B is a schematic of the single plane traces for forming two or more beams by feeding "N" antenna elements from two or more RF input ports.

In a further variation (see FIG. 2B) in which elements common to those of the preferred embodiment of FIGS. 2 and 2A are identified by a prime designation, two nearly independent beams can be realized by connecting the normally loaded isolated ports (ports 4) to a second beam-forming network. The two beam forming networks have at least two RF inputs employed as common ports (ports 1) receiving beam 1 and beam 2. Further, the plurality of output ports (ports 2) are connected discretely to the corresponding antenna (radiator) element (1–N) via the meander lines (30'–33') employed again for electrical phase matching. The plurality of four port directional coupler circuits are again implemented in transverse electro-magnetic mode each including parallel sections of transmission line with the first transmission line section being connected at one end to the RF source of excitation located at one of the common ports (ports 1). Also the first transmission line section is connectable to a second directional coupler port of a first directional coupler of the second beam forming network. The second beam forming network is then connected to a characteristic impedance termination point at the other end of the first transmission line section of the second beam forming network providing the fourth directional coupler port. Further, the three one-quarter wave conductive cross-over traces 11', 12' and 13' are positioned as to cross-over the parallel transmission line sections. The construction is as in FIGS. 2 and 2A in which the second directional coupler port is located along the first section of transmission line and the third directional coupler port is located along the second section of transmission line with the third port being diagonal to the first port. The output ports (ports 2) of the first beam forming network connect to the corresponding antenna (radiator) element (1–N) while the second port of the second beam forming network provides an output for connection to the fourth port of the first beam forming network. Finally the third port of each of the directional coupler circuits is connected to the first port of the succeeding directional coupler in each of the beam forming networks to provide RF excitation to each successive directional coupler while the first port of the first of the directional coupler circuits of each of the beam forming networks is connected to one of the common ports. The antenna element spacing is nearly arbitrary, $\lambda/2$ for example, but can be otherwise. The feed geometry can be such that radiating elements (1 through N) are connected directly at the stripline edge as suggested in FIG. 2, however, the outputs could be connected to coaxial cable or the like for antenna element connection if this is mechanically desirable.

Figure 4:
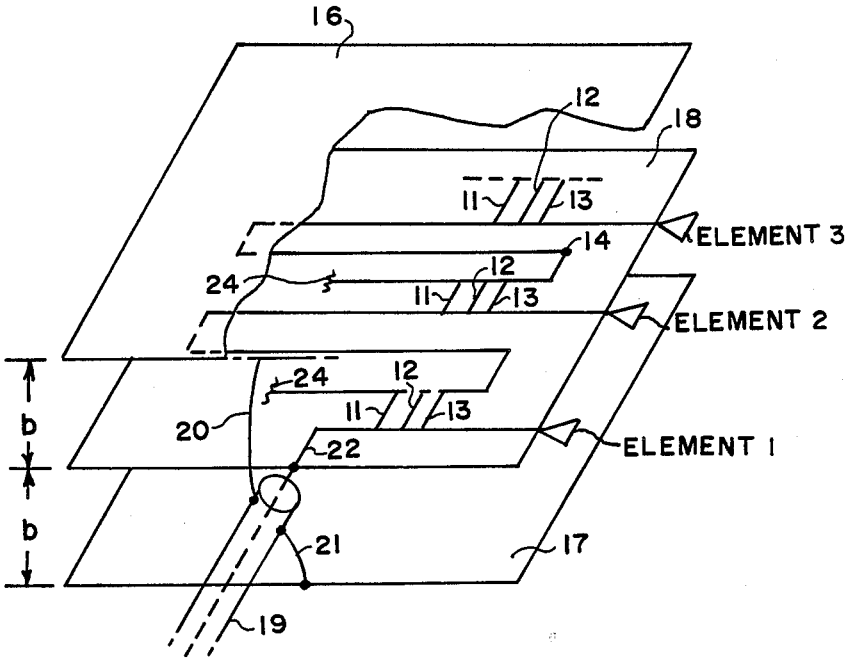
FIG. 4 is an isometric, partially sectioned view of a typical assembled stripline feed according to the invention.

Referring now to FIG. 4, the device of the invention is depicted with a pair of parallel conductive planes 16 and 17 each spaced "b" from the conductive cross-over traces 11, 12 and 13 on a dielectric sheet 18. As previously indicated, the honeycomb dielectric spacers of U.S. Pat. No. 3,518,688 (Stayboldt) can be provided in the spaces between 16 and 18 and between 17 and 18 as that patent reference shows. The conductive cross-over traces 11, 12 and 13 are applied to dielectric board 18 by known printed circuit methods. The conductive cross-over traces 11, 12, and 13 themselves are usually copper or one of its alloys.

To show how a coaxial input line 19 can be electrically connected to the device 10, a coaxial center conductor 22 is connected to the first port 1 in the coupler sections of FIG. 2. An outer conductive sleeve of the coaxial input line 19 would be connected to a plurality of ground planes as at 20 and 21. Of course a coaxial connector could be installed consistent with those connections if desired.

With an understanding of the invention, various modifications within the scope and spirit of the invention will suggest themselves to those of skill in this art. Accordingly, it is not intended that the scope of the invention should be regarded as limited by the drawings or the specifics of this description, these being intended to by typical and illustrative only.

What is claimed is:

1. A transverse electro-magnetic mode power dividing/combining antenna feed network having a common port and a plurality of output ports each for connection discretely to a corresponding element of a multi-element antenna array comprising:

a plurality of four port directional coupler circuits implemented in stripline and operated in transverse electro-magnetic mode, said directional coupler circuits each including first and second sections of transmission line, each of said first transmission line sections being connectable at one end to a source of RF excitation via said common port for providing a first directional coupler port, said first port of a first of said directional coupler circuits being connectable to said common port, and each of said second transmission line sections being connectable at one end to a characteristic impedance termination, said one end of said second transmission line providing a fourth directional coupler port, said first and second transmission line sections being substantially parallel conductive traces of said stripline;

first means within each of said directional coupler circuits comprising a plurality of quarter-wave conductive cross-over traces of transmission line tapped into said first and second transmission line sections and spaced one quarter-wave length along both of said lines, said quarter-wave conductive cross-over traces being substantially perpendicular to said first and second transmission line sections and being conductive on a dielectric sheet between spaced parallel ground planes;

second means within each of said directional coupler circuits comprising second and third directional coupler ports with said second directional coupler port being along said first transmission line section and said third directional coupler port being along said second transmission line section and being the diagonal port with respect to said first port, said second port providing said output port for connection to said corresponding element of said antenna array; and third means for connecting said third port of each directional coupler circuit to said first port of the succeeding directional coupler to provide successive RF excitation, extended transmission line traces being folded back parallel to said parallel conductive traces to connect between the third port of each directional coupler circuit and the first port of the next succeeding directional coupler circuit.

2. The combination according to claim 1 in which said quarter-wave conductive cross-over traces have predetermined admittances for controlling the fraction of the RF excitation at each of said directional coupler first ports diverted to the corresponding second port and therefore to said corresponding antenna element.

3. The combination according to claim 1 in which said common port excitation is applied from a transverse electro-magnetic mode connection between said common port and said ground planes.

4. The combination according to claim 1 in which all of said parallel conductive traces are geometrically congruent for each of said directional coupler circuits.

5. The combination according to claim 1 in which said parallel conductive traces are spaced laterally by at least three times the conductive trace width.

6. A transverse electro-magnetic mode power dividing/combining antenna feed network comprising, in combination:

a plurality of at least a first and a second beam forming network, each network having a plurality of at least first and second common ports and a plurality of output ports for connection discretely to a corresponding element of a multi-element antenna array;

a plurality of four port directional coupler circuits included in each of said beam forming networks, said circuits implemented in stripline and operated in transverse electro-magnetic mode, each of said directional coupler circuits including:

a first transmission line section having a first port located at one end thereof, and a second transmission line having a fourth port located at one end thereof, said sections being substantially parallel conductive traces of said stripline; each of said first ports of said first and second beam forming networks being connectable to a source of RF excitation, each of said fourth ports of said second beam forming networks being connectable to a characteristics impedance terminations;

first means within each of said directional coupler circuits comprising a plurality of quarter-wave conductive cross-over traces of transmission line tapped into said first and second transmission line sections and spaced one quarter-wave length along both of said lines;

second means within each of said directional coupler circuits of each of said first and second beam forming networks comprising second and third directional coupler ports with said second directional coupler port being along said first transmission line section and said third directional coupler port being along said second transmission line section and being the diagonal port with respect to said first port, said second port of said first beam forming network providing said output port for connection to said corresponding element of said antenna array and said second port of said second beam forming network providing said output port for connection to said fourth port of said first beam forming network; and third means for connecting said third port of each directional coupler circuit to said first port of the succeeding directional coupler in each of said beam forming networks to provide successive RF excitation, extended transmission lines traces being folded back parallel to said parallel conductive traces to connect between the third port of each directional coupler circuit and the first port of the next succeeding directional coupler circuit, said first port of a first of said directional coupler circuits of each beam forming network being connectable to one of said plurality of common ports.

* * * * *